United States Patent [19]

Kroppenstedt

[11] 4,003,477

[45] Jan. 18, 1977

[54] REWINDING MACHINE HAVING A ROLL TRANSFER APPARATUS

[75] Inventor: Dietmar Kroppenstedt, Griesheim, Germany

[73] Assignee: Maschinenfabrik Goebel, GmbH, Germany

[22] Filed: Dec. 17, 1974

[21] Appl. No.: 533,625

[30] Foreign Application Priority Data

Dec. 21, 1973 Germany ..... 2363861

[52] U.S. Cl. ..... 214/1 QB; 214/340; 198/717

[51] Int. Cl.[2] ..... B65G 3/00

[58] Field of Search ..... 214/1 QB, 338, 339, 214/340, DIG. 4, DIG. 3; 198/218, 20 R, 166, 167, 160; 242/65, 66

[56] References Cited

UNITED STATES PATENTS

| | | | |
|---|---|---|---|
| 2,420,343 | 5/1947 | Albertoli | 198/160 |
| 2,746,224 | 5/1956 | Wollett | 214/340 |
| 2,803,463 | 8/1957 | Longelli | 198/160 |
| 2,812,864 | 11/1957 | Martell | 214/1 QB |

FOREIGN PATENTS OR APPLICATIONS

| | | | |
|---|---|---|---|
| 649,937 | 2/1951 | United Kingdom | 214/DIG. 4 |

*Primary Examiner*—Robert J. Spar
*Assistant Examiner*—Kenneth Noland
*Attorney, Agent, or Firm*—Watson, Cole, Grindle & Watson

[57] ABSTRACT

An apparatus and corresponding process is provided for the transfer of a roll from the roll-up location of a rewinding machine to a storage location thereof. The transfer apparatus applies pressure against the circumference of the roll at its roll-up location for pressing the roll against its base while transferring the roll at a predetermined speed to the storage location.

8 Claims, 2 Drawing Figures

REWINDING MACHINE HAVING A ROLL TRANSFER APPARATUS

BACKGROUND OF THE INVENTION

This invention relates to an apparatus and corresponding process for the transfer of a roll of a continuous strip of material from a location at which the material has been rolled up by a rewinding machine to a storage location thereof.

A paper making machine is normally equipped with a winding device wherein the just manufactured continuous paper web is wound up into a roll. The winding quality of such roll, however, oftentimes fails to meet the quality requirements of the user since it may be funnel-shaped or otherwise irregularly shaped at its edges after leaving the winding device. Rewinding machines, such as disclosed in U.S. Pat. No. 1,354,463 to Cameron et al, have therefore been devised for unwinding an unacceptably wound roll from the winder and rewinding it into a more compact and a better quality roll. Such rewinders are often provided with devices for longitudinally slitting the unwound web so as to effect the rewinding of several continuous strips into rolls of shorter axial lengths as compared to the wound roll.

Similar winders and rewinders are likewise provided for webs of foil, textile fabrics, and the like.

After the continuous strips have been rolled to a predetermined size on a suitable core, they are transferred from the roll-up location of the winding apparatus to a storage location so that the location at which they were rewound is available for the successive rewinding of new rolls from the same continuous strip. During such successive rewinding operations, the strip of material may be diagonally cut when rolled to its predetermined size. A subsequent roll is thereafter rewound on a cylindrical core starting with this cut edge and, after being rewound to a predetermined size, may be again cut for repeating the rewinding operation.

Heretofore, either a crane or so-called thrust units, or devices for ejecting the rolls by pushing, were utilized for transferring these rewound rolls to a storage location. Such thrust units comprise, for example, pivotable grapple arms or clamps which grasp the roll about its circumference for lifting same and transporting it from the rewinding location to a storage location without using any type of guide means in between. Ejectors for the rewound rolls of the type disclosed in U.S. Pat. No. 3,178,125 to Greding have also been used. The storage location referred to can, for example, include a table having a stop member or members against which the roll rests. Also, as is well known, the storage location may be in the form of a trough of, for example, two guides with round cross-sections, or two carrying rollers adjacent one another.

However, during the utilization of such known transfer devices, it has been found that the rewound rolls, after being perfectly rewound, very often again became funnel-shaped or misaligned at their ends by the time they reached the storage location. Furthermore, with the use of such transfer procedures, the outer layers of the rolls are susceptible to damage when the rolls strike against the stop member at the storage location.

SUMMARY OF THE INVENTION

An object of the present invention is to provide an improved apparatus for transferring a roll from a rewinding location to a storage location while maintaining the perfect shape of the roll effected by the rewinder.

More specifically, it is the object of the present invention to prevent the rolls during such transfer from becoming funnel-shaped or otherwise out of flat alignment at their ends, and from having their outer layer or layers damaged as often happens when utilizing previously known transfer arrangements such as described above.

This objective is achieved by applying a predetermined force exceeding the weight of the rolls against their base and rolling them at a predetermined speed from the rewinding location to a storage location, while maintaining the application of such force.

A movable member is provided for pressing against the circumference of the roll to apply a predetermined force. For transferring the roll from the rewinding location to the storage location, such member is shifted in a direction of the storage location while causing the roll to rotate.

The movable member can be a belt, a band, a roller or any similar type member, which is in contact with the circumference of each roll and moves at a predetermined speed. For this purpose, if either a belt or band is utilized, one end of such member should be fixedly secured in place while its other end should be movably secured in place.

Also, such belt or band may be movable by means of at least one roller mounted on a bearing and capable of being shifted in the direction of roll movement. The roller is mounted on a support rod which may be given a predetermined force so as to cause the roller to press the belt against the circumference of the roll.

An endless belt may be likewise used, or a roller or rollers located at the end of a support which is shiftable in the moving direction.

Accordingly, with the apparatus and corresponding procedure of the present invention, rolls which are perfectly formed may be transferred in their same condition. Thus, there is a considerable improvement in the quality of the rolled strips which are available for subsequent processing as, for example, printing.

DESCRIPTION OF THE PREFERRED EMBODIMENTS

Figure 1:
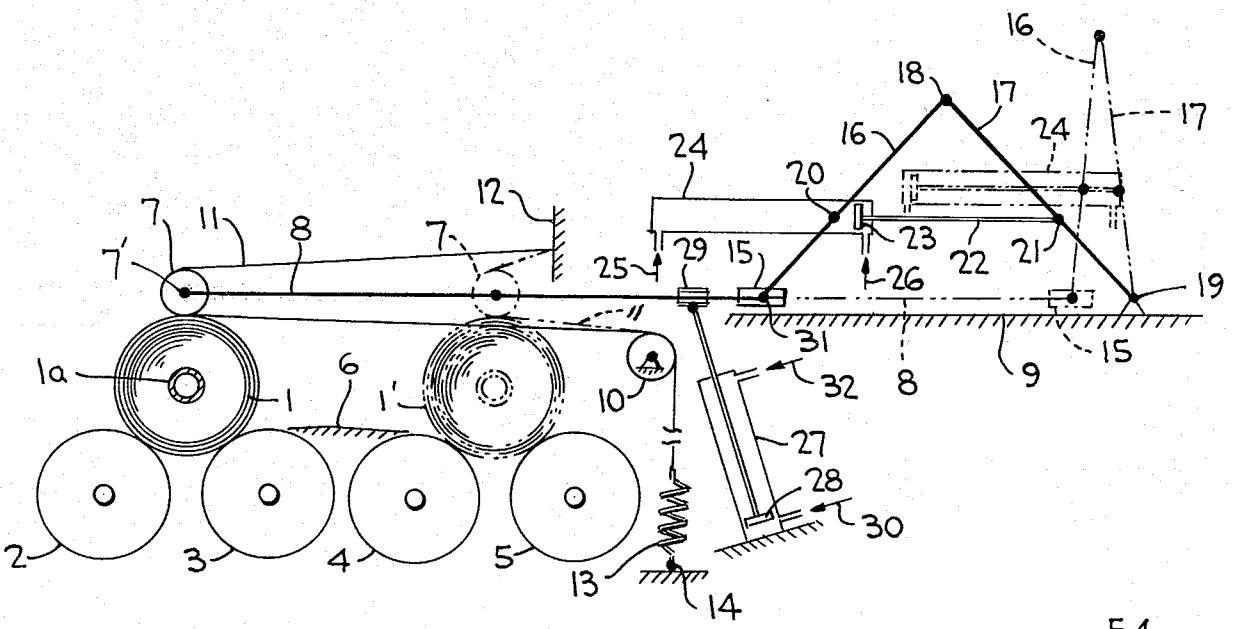
FIG. 1 is a schematic illustration in side elevation of a first embodiment of a transfer apparatus in accordance with the present invention.

In the embodiment illustrated in FIG. 1, a roll 1 of a continuous strip of material is shown at its rewinding location resting on carrying rollers 2 and 3 of a rewinding machine. Such carrying rollers are normally rotated about their respective axes by a suitable drive (not shown) for forming a roll such as 1 about its cylindrical core 1*a*. The drive means for rollers 2 and 3 is however disconnected so that they are effectively braked before roll 1 is transferred therefrom to a storage location which is constituted by the trough formed by rotatably mounted rollers 4 and 5. Such rollers are likewise effectively braked before the transfer operation. Roll 1 is therefore transferred to its position at 1′ illustrated in dotted outline by means of a transfer apparatus to be hereinafter described. A table 6 is disposed between carrying roller 3 and roller 4 so that its top surface is tangential with both these rollers, as shown. Carrying rollers 2 and 3 as well as rollers 4 and 5 and table 6 may, for example, be suitably mounted on the framework of the rewinding machine.

The transfer apparatus comprises a roller 7 mounted for free rotation on a bearing 7′ at the free end of a rigid rod 8. Rod 8 is disposed for shifting movement along a guide channel 9 (the upstanding flanges of which being omitted for clarity), which correspondingly causes the movement of roller 7 in the same direction. A flexible belt 11 partially extends about roller 7 so as to lie between roller 7 and roll 1. Belt 11 also extends partially about a roller 10 which is rotatably mounted at a fixed location. In place of belt 11, it is also possible to utilize either a flexible band or a chain which is similarly mounted. One end of belt 11 is rigidly secured as at 12 to the machine structure while the other end thereof is connected to the machine structure as at 14 through a spring mechanism 13. This spring mechanism, however, can be replaced by either a hydraulic or pneumatic cylinder or another similar device.

Rod 8 is connected to a slide member 15 which, in turn, is pivotally connected to a two-arm retractable guide mechanism. This guide mechanism includes a rigid guide rod 16 and a rigid guide rod 17, which are connected at a knee joint 18, and the mechanism is pivotally connected to the machine structure as at 19. A piston rod 22 of a piston 23, disposed for movement within a hydraulic or pneumatic cylinder 24, is connected as at 21 to guide rod 17. Cylinder 24 is connected at one side thereof to guide rod 16 as at 20, and the cylinder may, as required, be filled in any normal manner with fluid under pressure through inlet openings in the direction of arrows 25 and 26. Accordingly, fluid under pressure through 26 causes cylinder 24 to be moved relative thereto and, by reason of the connection between the cylinder and rod 16, causes this rod to move toward rod 17 to a position shown in phantom outline in FIG. 1. Moreover, slide member 15 is caused to slide along guide 9 thereby causing the shifting of rod 8 with its attached roller 7 to the position thereof also shown in phantom outline.

The transfer apparatus further includes a hydraulic or pneumatic cylinder assembly 27 for moving rod 8 in a direction approximately transverse to its sliding movement. The outer end of the piston rod disposed for sliding movement in cylinder 27 has a guide 29 surrounding rod 8, which guide corresponds to the cross-section of rod 8. By supplying fluid under pressure to cylinder 27 through an inlet opening in the direction of arrow 30, the piston rod is extended. Rod 8, which is hingedly connected to rod 16 as at 31, is therefore pivoted relative thereto upon extension of the piston rod. Accordingly, after slide member 15 is moved to its position shown in phantom outline, rod 8 may be shifted upwardly away from roll 1 and, after rods 16 and 17 are made to again assume their positions shown in solid outline, rod 8 with its roller 7 is lowered over roll 1. Roller 7 is made to directly overlie roll 1 such that the connecting line of the geometrical axes of roll 1 and roller 7 form an angle of approximately 90° with the connecting line of the geometrical axes of carrying rollers 2 and 3. Such lowering is effected by slowly outletting the fluid pressure from cylinder 27 in a direction opposite the direction of arrow 30. Roller 7 and thus belt 11 can be positioned so as to smoothly rest on the circumference of roll 1 as shown in FIG. 1. As soon as the pressure on the piston in the direction of arrow 30 has reached a value of zero, belt 11 is merely resting on roll 1 which accordingly presses against carrying rollers 2 and 3 by the weight of roller 7 and part of the weight of rod 8 and belt 11, which provide a force exceeding the weight of roll 1. In addition, roll 1 can be pressed against the support base comprising carrying rollers 2 and 3, table 6 and rollers 4 and 5, with still a greater force as fluid under pressure is supplied to cylinder 27 through an opening in the direction of arrow 32 which places a force on the other side of piston 28. In this manner, cylinder 27 exerts an additional force on rod 8 and correspondingly on roller 7, thereby increasing the pressure on roll 1.

By supplying fluid under pressure to cylinder 24 in the direction of arrow 26, cylinder 24, as shown in FIG. 1, is caused to move toward the right. During the corresponding movement of rod 8, the belt is pulled over rollers 7 and 10 as spring 13 compresses whereby shifting movement of the belt causes roll 1 to roll. With belt 11 resting on the circumference of roll 1, it is caused to be rolled at a predetermined speed to its position of 1′ shown in phantom outline. It can be therefore seen that movement of cylinder 24 causes the movement of slide member 15, rod 8, roller 7 and belt 11 toward the right whereby roll 1 is made to roll across the base, constituted by carrying roller 3, table 6 and roller 4 toward the right into its position 1′. During the entire period of the rolling, roll 1 is pressed by belt 11 against the base and thus tightly held on it. By controlling the supply of the fluid pressure to cylinder 24, the roll can also be brought to a soft stop against roller 5.

As soon as roll 1 has arrived at position 1′, rod 8 can be moved upwardly of roll 1 thereby lifting off belt 11 therefrom, by supplying cylinder 27 with fluid under pressure. This position of roller 7 can then be maintained until it is ready to transfer another roll which is rolled on carrying rollers 2 and 3. The transfer apparatus is then returned to its position shown in solid outline for transfer of this other roll to its storage location as in the manner aforedescribed.

Figure 2:
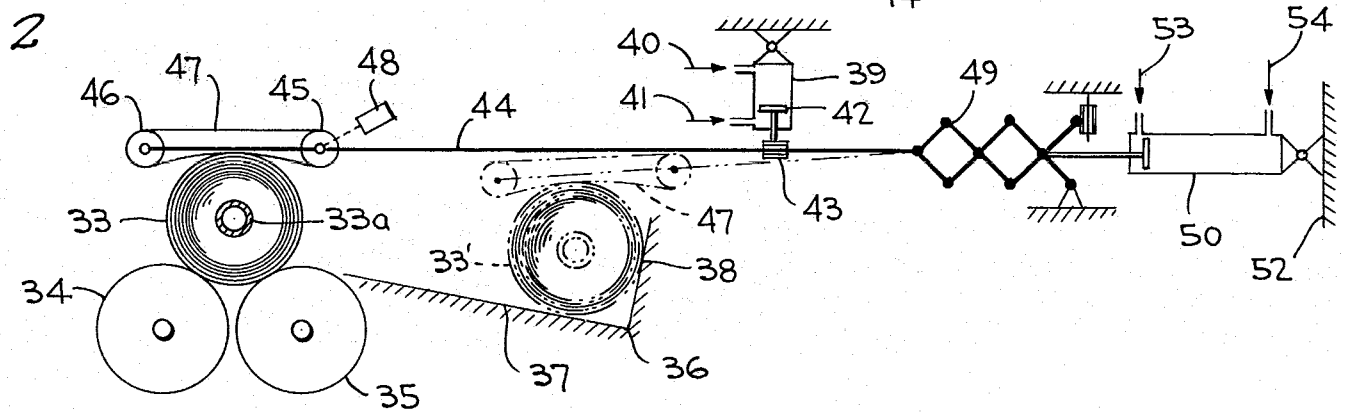
FIG. 2 is a schematic illustration in side elevation of a second embodiment of a transfer apparatus of the present invention.

In another embodiment shown in FIG. 2, roll 33 is similar to roll 1 in as much as it is a roll of a continuous strip having a core such as 33*a*. Roll 33 is shown after having been rewound by carrying rollers 34 and 35 which are similarly disposed as in the manner described for rollers 2 and 3. Roll 33 is transferred from its position resting on rollers 34 and 35 to its storage location 36. Such storage location includes a table 37 and a stop member 38 as part of the rewinding machine.

The transfer apparatus of this embodiment includes an endless belt 47 mounted about rollers 45 and 46. (It should be noted that a band, a chain or similar type of movable member may be used in lieu of the belt.) Pressure is supplied by belt 47 against the circumference of roll 33 by means of a pressure cylinder 39 operating in conjunction with a rigid support rod 44. Rollers 45 and 46 are rotatably mounted on rod 44 near the free end thereof. Fluid under pressure is supplied to cylinder 39 through openings in the direction of arrows 40 and 41 so as to cause a corresponding movement of piston 42 located within the cylinder. A guide 43 surrounding rod 44 is mounted at the outer end of the piston rod provided for piston 42. In this manner, support rod 44 can be either moved in a direction away from the circumference of roll 33 or in a direction toward such circumference, thereby causing a corresponding movement of rollers 45, 46 and belt 47. The contact between belt 47 and roll 33 is therefore controlled by actuation of cylinder 39. Although the extent of the pressure applied by belt 47 against roll 33 is primarily dependent upon the weight of rollers 45 and 46, belt 47, support rod 44 and a motor 48, it is possible to increase this force by supplying fluid under pressure to cylinder 39 through an opening in the direction of arrow 40. Motor 48 is provided for driving one of the rollers, such as roller 45, in a counter-clockwise direction, which assists in effecting the movement of roll 33 from its roll-up location to its storage location as belt 47 is caused to move.

This distance between rollers 45 and 46 is not critical except that they should be spaced apart at least sufficiently to avoid rod 44 interfering with roll 33. If this distance, however, is below a certain minimum dimension, the rollers will be sufficiently close so that belt 47 can be omitted. It is furthermore possible to utilize only one roller, for example, roller 45, which would be rotatably mounted on support 44.

Support 44 is connected with a piston rod of a piston 51 located in a cylinder 50 through a collapsible mechanism 49 which comprises a plurality of interconnected rigid rods, as shown, capable of collapsing and extending in a known manner. Cylinder 50 is connected to the machine structure as at 52. Fluid under pressure can be supplied to cylinder 50 through openings in the direction of either arrow 53 or 54, which respectively causes the movement of support 44 and thus rollers 45 and 46 as well as belt 47 in a direction between the roll-up location and the storage location. The pressure exerted against the circumference of roll 33 in the manner described above, movement of belt 47 in a counter-clockwise direction and in a direction from left to right, causes roll 33 to be pressed against the base, which is formed in carrying rollers 34 and 35 and table 37, and to be rolled therealong at a predetermined speed.

In conjunction with either of the embodiments of the present invention, corresponding control devices (not shown) are provided for controlling the supply of fluid under pressure and the drive of motor 48. In accordance with the present invention, it is also possible to provide constructions other than that shown without departing from the scope of the invention. For example, instead of using a single belt 11 or 47, several belts can be used and instead of one roll 1, several rolls can be distributed across the width of the rolling machine, for instance, one belt for each roll to be rolled.

It is noted that the above description and the accompanying drawings are provided merely to present exemplary embodiments of the present invention and that additional modifications of such embodiments are possible within the scope of this invention without deviating from the spirit thereof.

What is claimed is:

1. An apparatus for transferring a roll of wound material from a winding location to a storage location in such a manner so as to preserve the geometrical shape of the roll by preventing funnel formation of individual wound layers of the roll, the apparatus comprising:

means for applying pressure against the circumference of the roll, said means for applying pressure including a movable belt and means for urging said belt into contact with the surface of the outer layer of the roll, said means for urging said movable belt incluing a rotatable member and means for pressing said rotatable member towards the circumference of the roll;

and means for rolling the roll at a predetermined speed from the winding location to the storage location while maintaining pressure against the roll so as to prevent any distortion in the geometrical shape of the roll, said means for rolling the roll includes a support rod connected to said member and means for moving said support rod in a direction from the winding location toward the storage location so as to cause the simultaneous movement of said member in such direction thereby, in turn, causing the corresponding rolling of the roll.

2. An apparatus as defined in claim 1, wherein said means for pressing said rotatable member towards the roll includes means for applying a force upon said support rod so as to cause its movement and the corresponding movement of said member in a direction against the roll.

3. An apparatus as defined in claim 1, wherein said member is a roller and said movable belt is an endless belt mounted about said roller and another corresponding roller.

4. An apparatus for transferring a roll of material from a winding location to a storage location, comprising: means for applying pressure against the circumference of the roll, said means for applying pressure including a movable member and means for pressing said member against the circumference of the roll, said member having a movable roller rotatably mounted in a position adjacent the roll and a band having one end fixed at a stationary location and being wrapped around the roller so as to be positioned between said roller and the roll for being pressed against the roll and so as to be movable; and means for rolling the roll at a predetermined speed from the winding location to the storage location while maintaining pressure against the roll.

5. The apparatus as defined in claim 4, wherein said means for rolling the roll includes means for moving said band and said roller in a direction from the winding location towards the storage location.

6. An apparatus for transferring a roll of wound material from a winding location to a storage location in such a manner so as to preserve the geometrical shape of the roll by preventing funnel formation of individual wound layers of the roll, the apparatus comprising:

means for applying pressure against the circumference of the roll, said means for applying pressure including a movable belt and means for urging said belt into contact with the surface of the outer layer of the roll, said means for urging said movable belt including a rotatable member and means for pressing said rotatable member towards the circumference of the roll, said member including a movable roller rotatably mounted in a position adjacent the roll and said movable belt is wrapped about said roller and positioned between said roller and the roll for being pressed against the roll; and means for rolling the roll at a predetermined speed from the winding location to the storage location while maintaining pressure against the roll so as to prevent any distortion in the geometrical shape of the roll.

7. An apparatus as defined in claim 6, wherein one end of said movable belt is fixed at a stationary location and the other end of said belt is movable.

8. An apparatus as defined in claim 7, wherein said means for rolling the roll includes means for moving said belt and said roller in a direction from the winding location toward the storage location.

* * * * *